US005558170A

United States Patent [19]

Thigpen et al.

[11] Patent Number: 5,558,170

[45] Date of Patent: Sep. 24, 1996

[54] METHOD AND APPARATUS FOR IMPROVING DRILL BIT STABILITY

[75] Inventors: Gary M. Thigpen, Houston; William H. Sherwood, Jr., Spring; Coy M. Fielder, Cypress, all of Tex.

[73] Assignee: Baroid Technology, Inc., Houston, Tex.

[21] Appl. No.: 350,362

[22] Filed: Dec. 6, 1994

Related U.S. Application Data

[63] Continuation-in-part of Ser. No. 996,151, Dec. 23, 1992, abandoned, and a continuation-in-part of Ser. No. 312,260, Sep. 26, 1994, Pat. No. 5,449,048.

[51] Int. Cl.[6] ..... E21B 10/46

[52] U.S. Cl. ..... 175/57; 175/426; 175/431

[58] Field of Search ..... 175/426, 428, 175/430, 431, 432, 57

[56] References Cited

U.S. PATENT DOCUMENTS

| | | | |
|---|---|---|---|
| Re. 32,036 | 11/1985 | Dennis | 175/329 |
| 4,106,578 | 8/1978 | Beyer | 175/407 |
| 4,499,958 | 2/1985 | Radtke et al. | 175/428 |
| 4,558,753 | 12/1985 | Barr | 175/431 |
| 4,606,418 | 8/1986 | Thompson | 175/329 |
| 4,640,375 | 2/1987 | Barr et al. | 175/329 X |
| 4,753,305 | 6/1988 | Fisher | 175/410 |
| 4,872,520 | 10/1989 | Nelson | 175/329 |
| 4,941,538 | 7/1990 | King | 175/329 |
| 4,984,642 | 1/1991 | Renard et al. | 175/329 |
| 4,991,670 | 2/1991 | Fuller et al. | 175/428 |
| 5,010,789 | 4/1991 | Brett et al. | 76/108.2 |
| 5,042,596 | 8/1991 | Brett et al. | 175/57 |
| 5,078,219 | 1/1992 | Morrell et al. | 175/410 |
| 5,090,492 | 2/1992 | Keith | 175/426 X |
| 5,178,222 | 1/1993 | Jones et al. | 175/398 |
| 5,186,268 | 2/1993 | Clegg | 175/399 |
| 5,238,075 | 8/1993 | Keith et al. | 175/431 |
| 5,346,025 | 9/1994 | Keith et al. | 175/57 |

FOREIGN PATENT DOCUMENTS

| | | | |
|---|---|---|---|
| 0572761 | 8/1993 | European Pat. Off. . | |
| 1239250 | 6/1986 | Russian Federation | 175/426 |
| 1684464 | 10/1991 | Russian Federation | 175/426 |
| 2086451 | 5/1982 | United Kingdom | 175/431 |
| 2152104 | 7/1985 | United Kingdom . | |
| 2276645 | 10/1994 | United Kingdom . | |

OTHER PUBLICATIONS

Carbide Supported Edge "CSE", from Advantage Technology.

Hybrid Cutter PDC Bits, from Hycalog.

Impact Arrestors, from Security Diamond Products.

*Primary Examiner*—Hoang C. Dang

*Attorney, Agent, or Firm*—Browning Bushman

[57] ABSTRACT

A drag bit having a plurality of blades or ribs on its end face has one or more pockets milled into the top surfaces of said blades. A tungsten carbide button or insert is positioned at the gauge diameter to reduce impact on the gauge diameter cutter in each of the fibs. The tungsten carbide button extends to the borehole gauge diameter to stabilize the bit within the borehole to limit bit whirling. The tungsten carbide button extends just forward of at least the final cutter assembly with respect to the direction of bit rotation to take the impact instead of the cutters. An additional tungsten carbide button or a shaped cutter is used along the blades in line with PDC cutting assemblies for limiting the penetration of the PDC cutting assemblies to thereby limit bit whirling or tilting instabilities. A shaped PDC cutter has a beveled edge with a bevel angle greater than the backrake angle of the PDC cutter so that engagement with the borehole wall is made with the tungsten carbide body rather than the PDC cutting portion to thereby function as a penetration limiter. As the bit wears, the PDC cutting portion begins to engage the formation in the same manner as the other PDC cutting assemblies.

8 Claims, 12 Drawing Sheets

FIG. 7
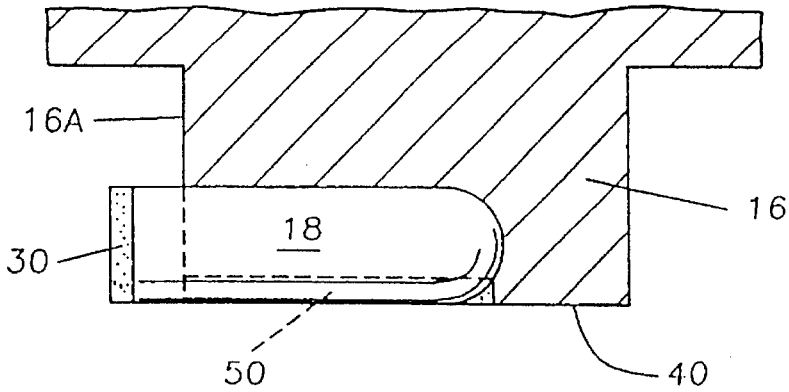
FIG. 8
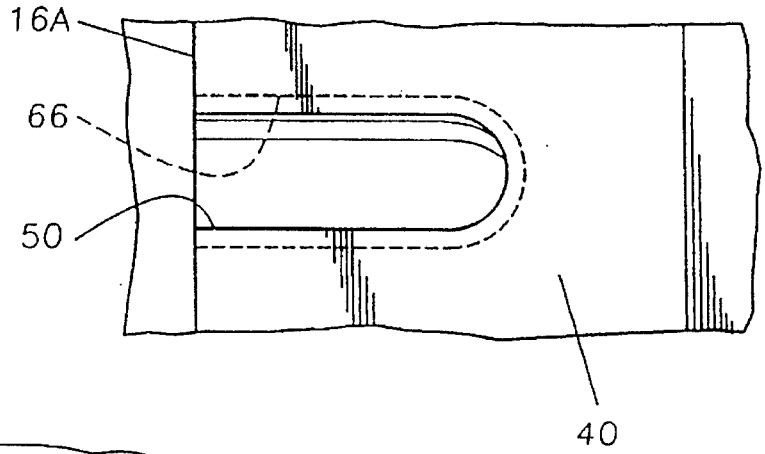
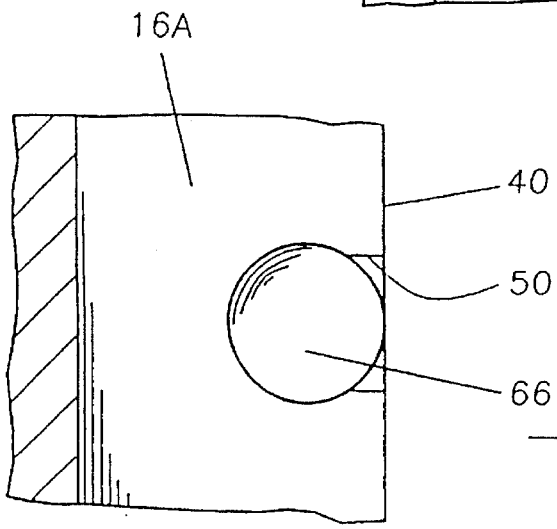
FIG. 9
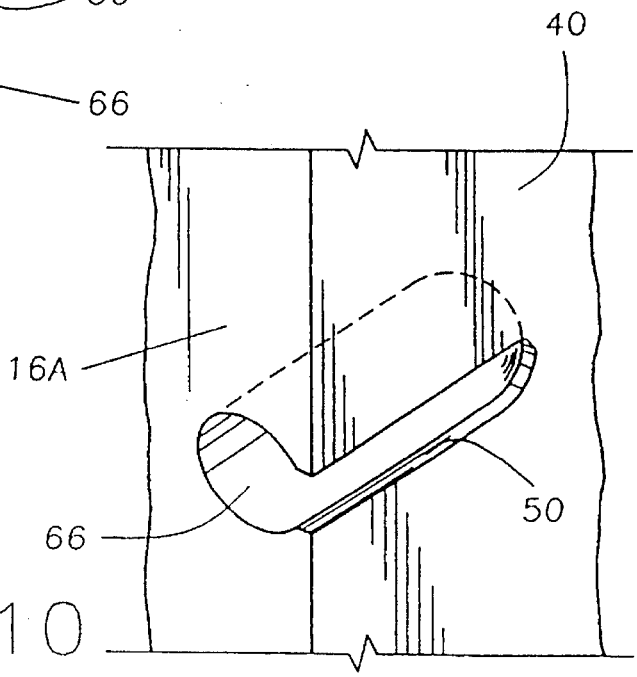
FIG. 10

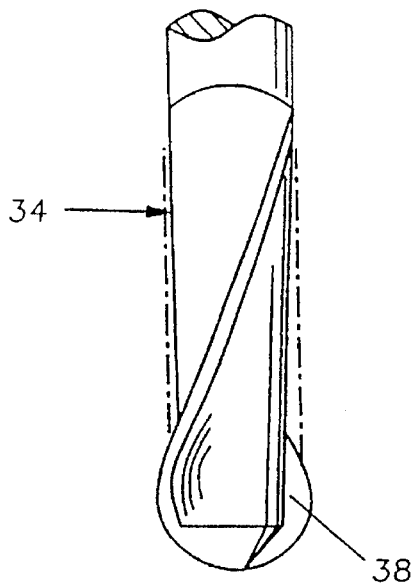
FIG. 11
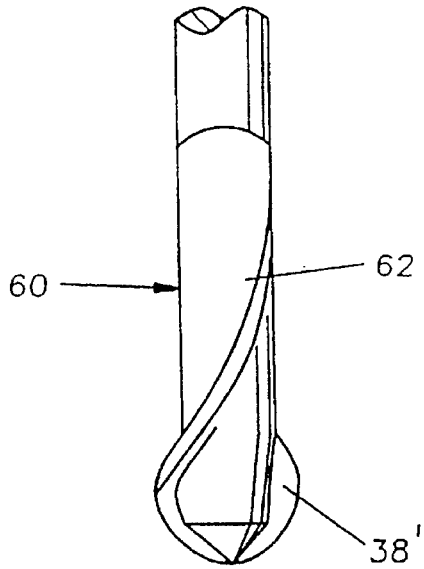
FIG. 12
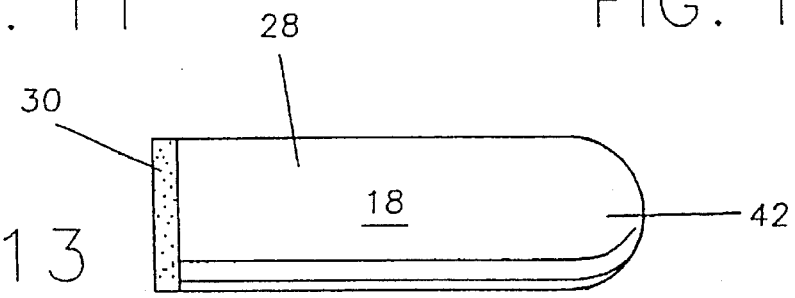
FIG. 13
FIG. 14
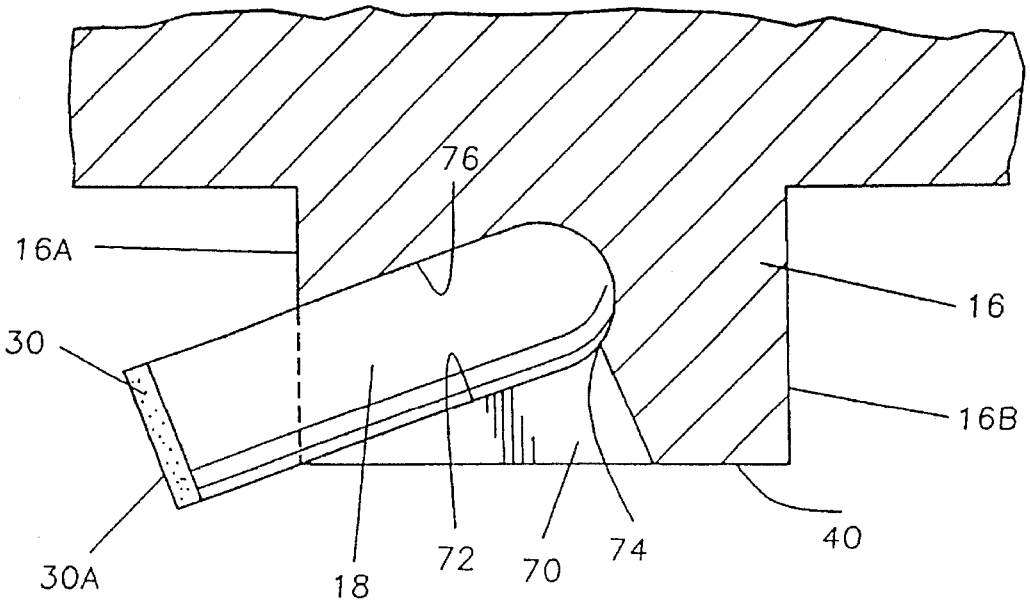

METHOD AND APPARATUS FOR IMPROVING DRILL BIT STABILITY

BACKGROUND OF THE INVENTION

This application is a continuation-in-part of U.S. application Ser. No. 7/996,151 filed Dec. 23, 1992, abandoned, and U.S. application Ser. No. 08/312,260 filed Sep. 26, 1994, issued as U.S. Pat. No. 5,449,048 on Sep. 12, 1995.

1. Field of the Invention

The present invention relates generally to drill bits used for the drilling of oil and gas wells, and also relates to methods for manufacturing such drill bits. Such bits are used in drilling earth formations in connection with oil and gas exploration and production.

2. Description of the Prior Art

It is well known in prior art drill bits to use cutting elements having on one end thereof a polycrystalline diamond compact, generally referred to as a "PDC." The PDC material is typically supplied in the form of a relatively thin layer on one face of a substantially larger mounting body. The mounting body is usually a stud-like end configuration and typically is formed of a relatively hard material such as sintered tungsten carbide. The diamond layer may be mounted directly on the stud-like mounting body, or it may be mounted via an intermediate disc-like carrier, also typically comprised of sintered tungsten carbide. In any event, the diamond layer is typically disposed at one end of the stud-like mounting body, the other end of which is mounted in a bore or recessed in the body of the drilling bit.

The bit body itself is typically comprised of one of two materials. The body is either a tungsten carbide matrix or is made of various forms of steel. When the body is made of steel, the pocket for receiving the stud is usually in the shape of a cylinder to receive the cylindrically shaped stud of the cutter.

It has been well known in this art that when the bit body is comprised of a tungsten carbide matrix, the pockets can be formed in whatever shape is desirable. For example, in U.S. Pat. No. 4,200,159 to Eberhard Peschel et al., there is disclosure that the cutter body can be in the form of a cylinder as illustrated in FIG. 7 of that patent or can be in the form of a pin (see FIG. 14) or in the form of a cone as illustrated in FIGS. 15 and 16 of U.S. Pat. No. 4,200,159.

When using a so-called blade cutter, those skilled in the art of making steel bodied bits have usually machined the cylindrical pockets from the front of the blade, thereby limiting access to the center of the bit.

We have discovered that by using a PDC cutter having a center cylindrical section and a spherical section on one end away from the PDC cutter end, thus essentially being in the shape of a bullet, the cutter can be placed in a pocket conforming, at least in part, to the spherical end of the cutter. We are thus able to provide cutter locations in the center of the bit that have not been previously available to those in the art.

A significant source of many drilling problems relates to drill bit and string instability. There are many types of such instability. Bit and/or string instability probably occurs much more often than is readily apparent by reference to immediately noticeable problems. However, when such instability is severe, it places high stress on drilling equipment that includes not only drill bits but also downhole tools and the drill string in general. Common problems caused by instability may include, but are not limited to, excessive torque, directional drilling control problems, and coring problems.

One typical approach to solving these problems is to over-design the products to thereby resist the stress. However, this solution is usually expensive and can actually limit performance in some ways. For instance, one presently commercially available drill bit includes reinforced PDC members that are strengthened by use of a fairly large taper, or frustoconical contour on the PDC member. The taper angle is smaller than the backrake angle of the cutter to allow the cutter to cut into the formation at a desired angle. While this design makes the PDC cutters stronger to thereby reduce cutter damage, it does not solve the primary problem of bit instability. Thus, drill string problems, directional drilling control problems, and excessive torque problems remain. Also, because the PDC diamond table must be ground on all of the PDC cutters, the drill bits made in this manner are more expensive and less resistant to abrasive wear as compared to the same drill bit made with standard cutters.

Another prior art solution to bit instability problems is directed toward a specific type of bit instability that is generally referred to as bit whirl. Bit whirl is a very complicated process that includes many types of bit movement patterns or modes of motion wherein the bit typically does not remain centered within the borehole. The solution is based on the premise that it is impossible to design and build a perfectly balanced bit. Therefore, an intentionally imbalanced bit is provided in a manner that improves bit stability. One drawback to this method is that for it to work, the bit forces must be the dominant force acting on the bit. The bits are generally designed to provide for a cutting force imbalance that may range about 500 to 2000 pounds depending on bit size and type. Unfortunately, there are many cases where gravity or string movements create forces larger than the designed cutting force imbalance and therefore become the dominant bit forces. In such cases, the intentionally designed imbalance is ineffective to prevent the bit from becoming unstable and whirling.

Yet another attempt to reduce bit instability, requires devices that are generally referred to as penetration limiters. Penetration limiters work to prevent excessive cutter penetration into the formation that can lead to bit whirl or cutter damage. These devices may act to prevent not only bit whirl but also prevent radial bit movement or tilting problems that occur when drilling forces are not balanced.

As discussed in more depth hereinafter, penetration limiters should preferably satisfy two conditions. First, when the bit is drilling smoothly (no excessive forces on the cutters), the penetration limiters must not be in contact with the formation. Second, if excessive loads do occur either on the entire bit or to a specific area of the bit, the penetration limiters must contact the formation and prevent the surrounding cutters from penetrating too deeply into the formation.

Prior art penetration limiters are positioned behind the bit to perform this function. The prior art penetration limiters fail to function efficiently, either partially or completely, in at least two circumstances. Once the bit becomes worn such that the PDC cutters develop a wear flat, the prior art penetration limiters become inefficient because they begin to continuously contact the formation even when the bit is drilling smoothly.

In fact, a bit with worn cutters does not actually need a penetration limiter because the wear flats act to maintain stability. An ideal penetration limiter would work properly when the cutters are sharp but then disappear once the cutters are worn.

Another shortfall of prior art penetration limiters is that they cannot function if the bit is rocked forward, as may occur in some types of bit whirling or tilting. The rear positioning of prior art penetration limiters results in their being lifted so far from the formation during bit tilting that they become ineffective. Thus, to be most effective, the ideal penetration limiter would be in line with the cutters rather than behind or in front. However, this positioning takes space that is used for the cutters.

Consequently, there remains a need for improved devices and methods for reducing bit and drill string instability. There remains a need for an ideal penetration limiter that works actively while the cutters are sharp but then disappears once the cutters are worn. The ideal penetration limiter would not be placed in front of or behind the cutters where it may become inoperative due to bit tilting. Rather the ideal penetration limiter would be in line with the cutters without substantially compromising necessary cutter spacing. Furthermore, there remains a need for a stabilizer element that reduces the tendency for the bit to whirl and also protects cutters from impacting irregularities in the borehole. Those skilled in the art have long sought and will appreciate the present invention that provides solutions to these and other problems.

SUMMARY OF THE INVENTION

The objects of the invention are accomplished, generally, by the provision of a new and improved drill bit for drilling a borehole through a formation, with the borehole having a borehole gauge diameter and a borehole wall, and the drill bit having a drilling rotation direction. The drill bit comprises a hard metal body having an end face and having a plurality of PDC cutter assemblies disposed on the end face for engaging the formation. The plurality of PDC cutter assemblies includes at least one final PDC cutter assembly that is axially and laterally spaced from a central region of the end face. A first metal body is disposed adjacent to the at least one final PDC cutter and has a first sliding surface profiled to extend outwardly for substantially continuous sliding contact along the borehole wall rather than cutting into the borehole wall. A second metal body is disposed radially outwardly with respect to the center point of the end face. The second metal body has a second sliding surface profiled to extend outwardly a distance less than a neighboring PDC cutter and is operable to engage the formation when the neighboring PDC cutter cuts too deeply into the formation for substantially sliding rather than cutting engagement with the formation.

The first metal body preferably contacts the borehole wall just forward, with respect to the drilling rotation direction, of a final PDC cutter assembly. The second metal body is preferably provided with a PDC member. The second metal body extends outwardly a distance toward the formation greater than the PDC member, at least with a new bit.

For the method of stabilizing the drill bit, a plurality of PDC cutter assemblies are provided with each having a PDC portion and a metallic body portion. A plurality of upsets are provided that extend along the drill bit. The plurality of PDC cutter assemblies are mounted along each of the upsets such that the PDC portion of each of the plurality of PDC cutter assemblies extend outwardly by a respective engagement distance from a respective of the plurality of upsets to thereby cut into the formation. A plurality of first hard metal inserts are formed with each having a respective first sliding surface shaped for substantially sliding rather than cutting engagement with the formation. A plurality of second hard metal inserts are provided with each having a respective second sliding surface shaped for substantially sliding rather than cutting engagement with the formation. Each of the plurality of first metal inserts are mounted on a laterally outwardly portion of at least two of the plurality of upsets. Each of the first sliding surfaces extend to the borehole gauge diameter for substantially continuous sliding engagement with the borehole wall. Each of the plurality of second metal inserts are mounted adjacent a neighboring PDC cutter assembly on at least two of the plurality of upsets. Each of the second sliding surfaces are mounted to extend outwardly from a respective upset by a distance less than the respective engagement distance of the neighboring PDC cutter assembly so that each of the second sliding surfaces are engageable with the borehole wall only when the neighboring PDC cutter assembly cuts too deeply into the borehole wall. The second sliding surface is preferably worn away by drilling to allow a PDC cutter assembly to engage the formation.

An object of the present invention is to provide an improved method and apparatus for stabilizing a drill bit.

Another object of the present invention is to provide surfaces designed to slide rather than cut into the formation at various positions on the bit to stabilize the bit.

A feature of the present invention is a hard metal insert in the gauge region of the bit and extending outwardly to a borehole gauge diameter to engage the borehole just ahead of a final PDC cutter assembly with respect to the drilling rotation direction.

Another feature of the present invention is a PDC cutting element positioned between two other PDC cutting elements but extending outwardly by a smaller distance.

Another feature of the present invention is a PDC cutting element having a metallic body section that engages the formation instead of the PDC cutting element.

An advantage of the present invention is a relatively low cost method for improving drill bit stability.

Another advantage of the present invention is that the penetration limiter effectively disappears after the bit becomes worn.

These and other objects, features, and advantages of the present invention will become apparent from the drawings, the descriptions given herein, and the appended claims.

BRIEF DESCRIPTION OF DRAWINGS

FIG. 7 is an alternative embodiment of a cutting structure brazed into place of a pocket within one of the ribs of the drill bit illustrated in FIGS. 1 and 2 in accord with the present invention;

FIG. 8 is a top plan view of a slot milled into the top surface of the rib illustrated in FIG. 7;

FIG. 9 is an end view of the slot illustrated in FIG. 8;

FIG. 10 is a pictorial view of the slot and the pocket milled into the rib illustrated in FIGS. 7–9;

FIG. 11 is a pictorial view of a ball nosed end mill used in the manufacturing process in accord with the present invention;

FIG. 12 is an alternative ball nosed end mill having a reduced shank that is sized to pass through the slot illustrated in FIGS. 7–10;

FIG. 13 is a pictorial view of a bullet-shaped cutter in accord with the present invention;

FIG. 14 is an elevated view of an alternative embodiment of the present invention in which the cutter is brazed into place in a pocket angled away from the top surface of the rib in accord with the present invention;

Figure 1:
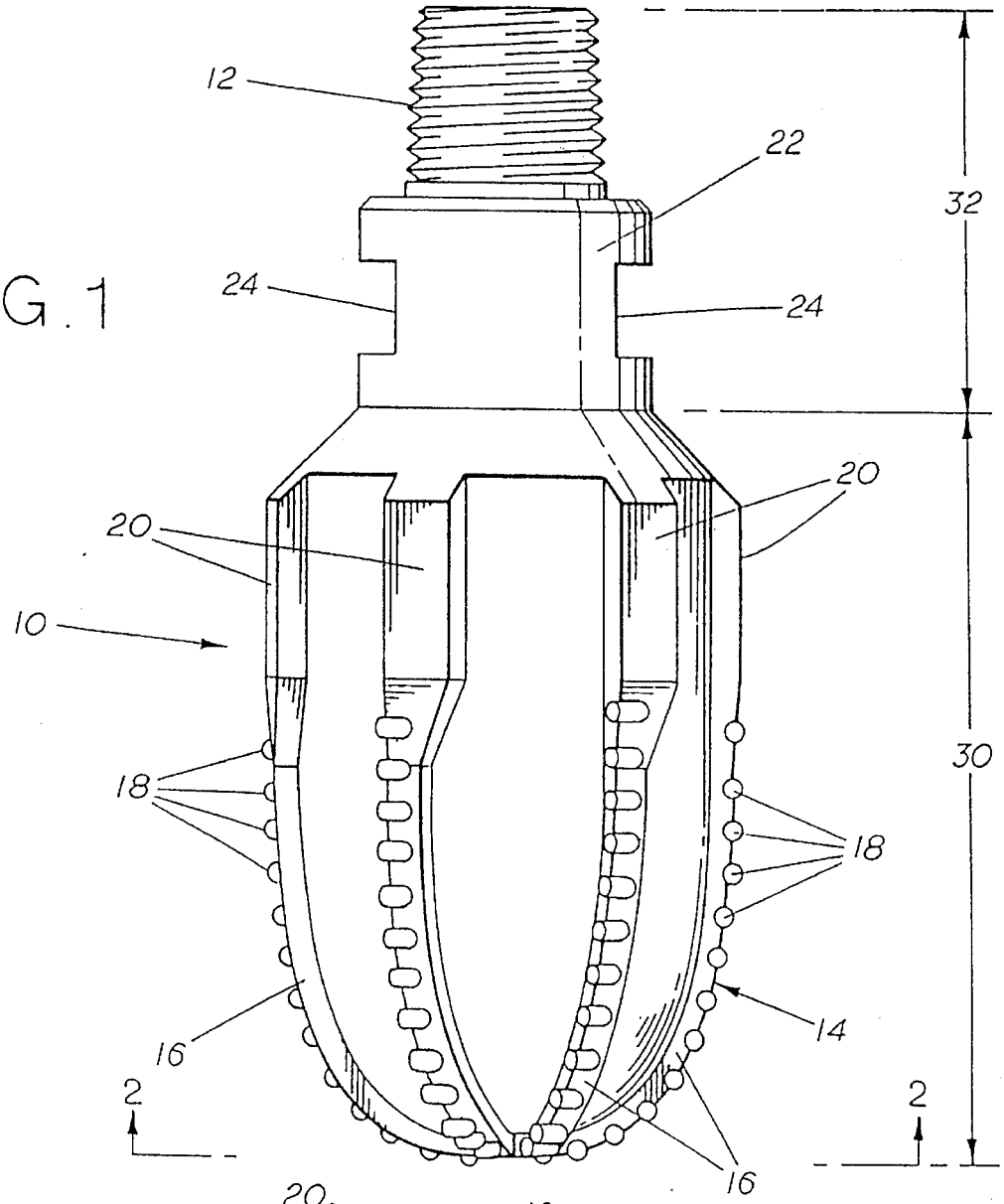
FIG. 1 is an elevated, pictorial view of a drill bit in accordance with the present invention.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENT

FIGS. 1, 2, 34, and 35 depict a drill bit of the type in which the present invention may be used. As used herein, "drill bit" will be broadly construed as encompassing both full bore bits and coring bits. Bit body 10, manufactured from steel or another hard metal, has a threaded pin 12 at one end for connection in the drill string, and an operating end face 14 at its opposite end. The "operating end face" as used herein includes not only the axial end or axially facing portion shown in FIG. 2, but also contiguous areas extending up along the lower sides of the bit, i.e., the entire lower portion of the bit that carries the operative cutting members described herein below. More specifically, the operating end face 14 of the bit is transversed by a number of upsets in the form of ribs or blades 16 radiating from the lower central area of the bit and extending across the underside and up along the lower side surfaces of the bit. Ribs 16 carry cutting members 18, to be described more fully below. Just above the upper ends of rib 16, bit 10 has a gauge or stabilizer section, including stabilizer ribs or kickers 20, each of which is continuous with a respective one of the cutter carrying rib 16. Ribs 20 contact the walls of the borehole that has been drilled by operating end face 14 to centralize and stabilize the bit and to help control its vibration.

Intermediate the stabilizer section defined by ribs 20 and the pin 12 is a shank 22 having wrench flats 24 that may be engaged to make up and break out the bit from the drill string (not illustrated). With reference again to FIG. 2, the underside of the bit body 10 has a number of circulation ports or nozzles 26 located near its centerline, nozzles 26 communicating with the inset areas between rib 16, which areas serve as fluid flow spaces in use.

Figure 2:
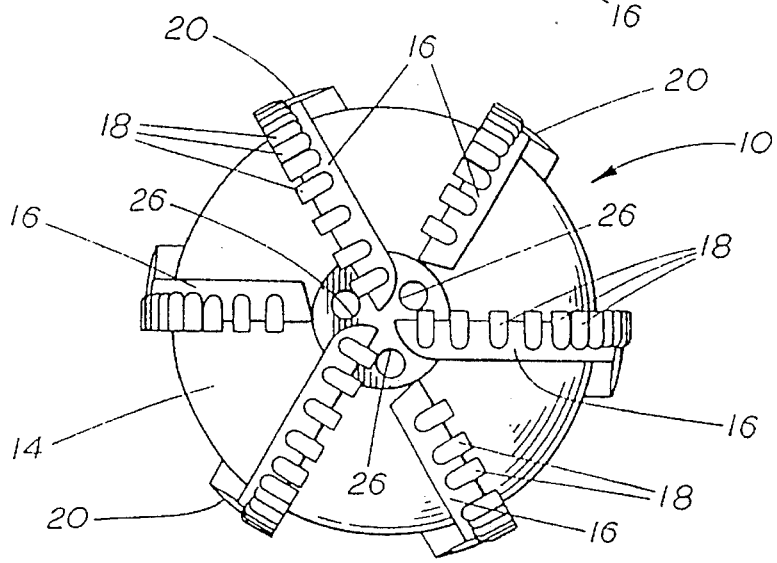
FIG. 2 is an end view of the working face of the drill bit in accordance with FIG. 1.
Figure 3:
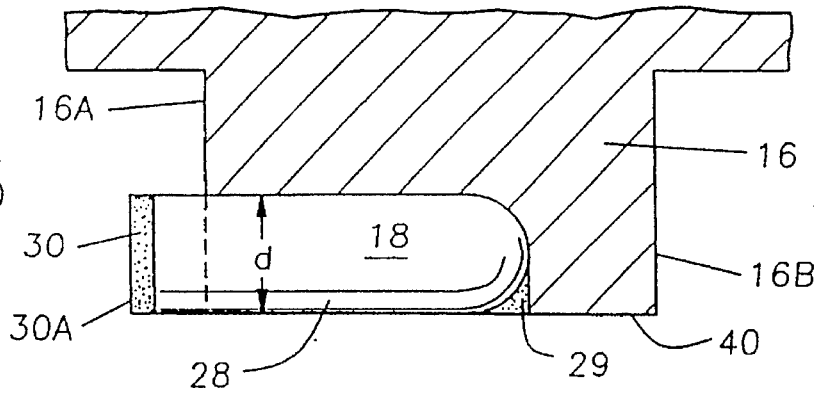
FIG. 3 is an elevated view of a cutting structure brazed in the place within a pocket milled into a rib of the drill bit in accord with FIGS. 1 and 2 of the present invention.

With reference now to FIG. 3 in conjunction with FIGS. 1 and 2, bit body 10 is intended to be rotated in the counter clockwise direction, as viewed in FIG. 2. Thus, each of the ribs 16 has a leading edge surface 16A and a trailing edge surface 16B. As shown in FIG. 3, each of the cutting members 18 is comprised of a mounting body 28 comprised of sintered tungsten carbide or some other suitable material, and a layer 30 of polycrystalline diamond carried on the leading face of the stud 28 and defining the cutting face 30A of the cutting member. The cutting members 18 are mounted in the respective ribs 16 so that their cutting faces are exposed through the leading edge surfaces 16A, respectively. The rib 16 is itself comprised of steel or some other hard metal. The tungsten carbide cutter body 28 is brazed into a pocket 32 (illustrated in FIG. 4) and includes within the pocket the excess braze material 29.

Figure 4:
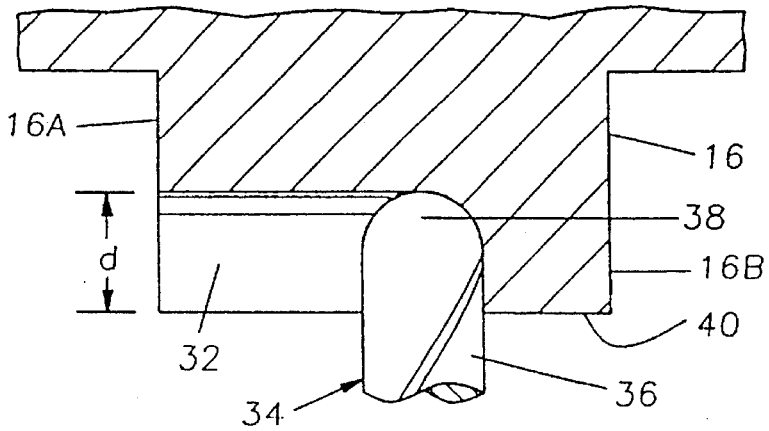
FIG. 4 is an elevated view of a ball nosed end milling tool being used to mill the pocket in the rib illustrated in FIG. 3 in accord with the present invention.

With reference now to FIG. 4, the pocket 32 is milled into the blade 16 through the use of a ball-nosed end mill having a shank 36 and a ball- (spherical-) nosed end 38. In the operation of the ball-nosed end mill 34 illustrated in FIG. 4, the pocket 32 is milled into the blade or upset 16 a depth "d" that in the embodiment of FIGS. 3 and 4 exactly matches the diameter of the stud body 28 illustrated in FIG. 3. By using a ball-nosed end mill, the pocket also has a spherically shaped end that conforms to the spherically shaped end 42 of the stud 18, as illustrated in FIG. 13. Thus, the cutter assembly 18 is placed within the pocket 32 and is brazed therein by brazing techniques well known to those skilled in the art. The addition of the braze material 29 can be used to have the cutter assembly conform completely to the pocket 32 if desired.

Under the assumption that the depth "d" of the pocket 32 exactly matches the diameter of stud body 28, no portion of the cutter extends below the surface 40, thus creating a problem, as those skilled in the art will immediately recognize. While being sound in structure, with the spherical end of the cutter exactly conforming to the end of the pocket, the embodiment of FIGS. 3 and 4 cannot be used to cut into the rock formations, since the cutter face 30A preferably extends below the surface 40.

Figure 5:
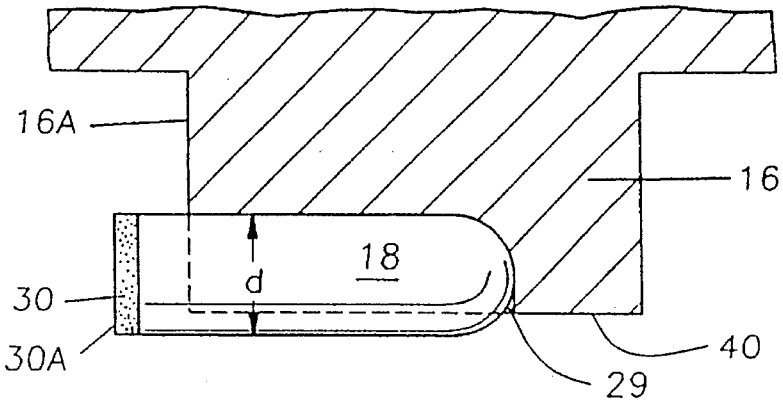
FIG. 5 is an alternative embodiment of the present invention showing a cutting structure brazed into place within a pocket in the rib of a drill bit illustrated in FIGS. 1 and 2 in accord with the present invention.
Figure 6:
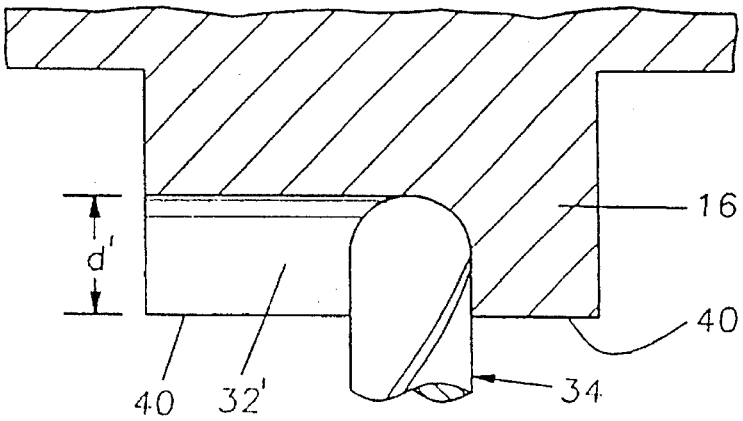
FIG. 6 is an elevated view of an alternative embodiment of a pocket being milled into one of the ribs of the drill bit according to FIGS. 1 and 2 in accord with the present invention.

FIGS. 5 and 6 illustrate a slightly different embodiment in which the ball-nosed end mill 34 is used to mill a pocket 32' having a depth d' that is less than the diameter of the stud body 28. Thus, when the cutter assembly 18 is brazed within the pocket 32', the cutter assembly will protrude slightly below the top surface 40 of the blade 16. As was the case with the embodiment shown in FIGS. 3 and 4, the cutter assembly 18 is brazed into the pocket 32' and the additional braze material 29 can be used to make a larger portion of the spherical end of the cutter conform to the pocket if desired. It should be appreciated that in each of the embodiments shown in FIGS. 3–6, the ball-nosed end mill allows the pocket 32 or 32' to be milled into the top surface 40 of the upset 16, commencing at the leading edge surface 16A.

FIGS. 7–10 illustrate an alternative embodiment of the present invention. A first slot 50 is milled into and parallel 20 the top surface 40 having a length that is slightly shorter than the length of the cutting structure 18 and having a width slightly smaller than the diameter of the cylindrical portion 28 of the cutting structure. In the preferred embodiment, the one end of the slot 50 is semicircular-shaped as illustrated in FIG. 8, but the slot can be squared off or have another shape if desired. After the slot 50 is milled into the surface 40, a reduced shank diameter ball-nosed end mill 60 (FIG. 12) is used to mill a pocket 66 into the leading face 16A. The shank 62 is reduced in diameter from that of the normal shank diameter illustrated in FIG. 11 and is sized such as to pass through the slot 50 in milling the pocket 66. As was the case with respect to FIGS. 3–6, the end result is a pocket 66 that conforms to the shape of the cutting structure 18 illustrated in FIG. 13.

Thus, whereas the cutting structure 18 is only partially conformed to the spherical end of the pocket 32 or pocket 32' illustrated in FIGS. 5 and 6, the cutting structure 18 is substantially conformed to the spherical end of the pocket 66 illustrated in FIGS. 7–10. As is illustrated and described with respect to FIGS. 3–6, the cutter assembly 18 illustrated with respect to FIGS. 7–10 is brazed into the pocket 66.

Figure 15:
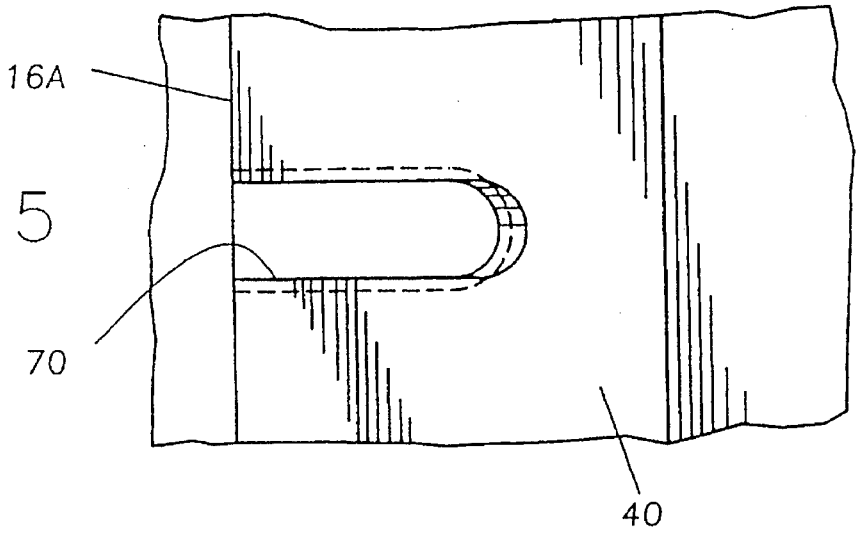
FIG. 15 is a top plan view of the slot milled into the top surface of the fib illustrated in FIG. 14.

However, the embodiment illustrated in FIGS. 7–10 has a problem similar to the problem discussed about with respect to FIGS. 3 and 4, viz., that of the cutter face 30A not extending below the surface 40. FIGS. 14 and 15 illustrate an alternative embodiment that alleviates that problem.

For example, in FIG. 14, instead of milling the slot 70 parallel to the surface 40 (as illustrated in FIG. 7), the slot 70 is milled having a bottom surface 72 commencing at the intersection of surfaces 16A and 40 and angles up to the point 74. FIG. 15 shows a top plan view of the surface 40 having the slot 70 milled therein. The reduced shank end mill illustrated in FIG. 12 is then used to mill out the pocket 76 into which the bullet-shaped cutter 18 is brazed, with the spherical end 42 of the cutter conforming to the spherical end of pocket 76. The slot 70 is preferably filled with braze material to fill out the surface 40.

Figure 16:
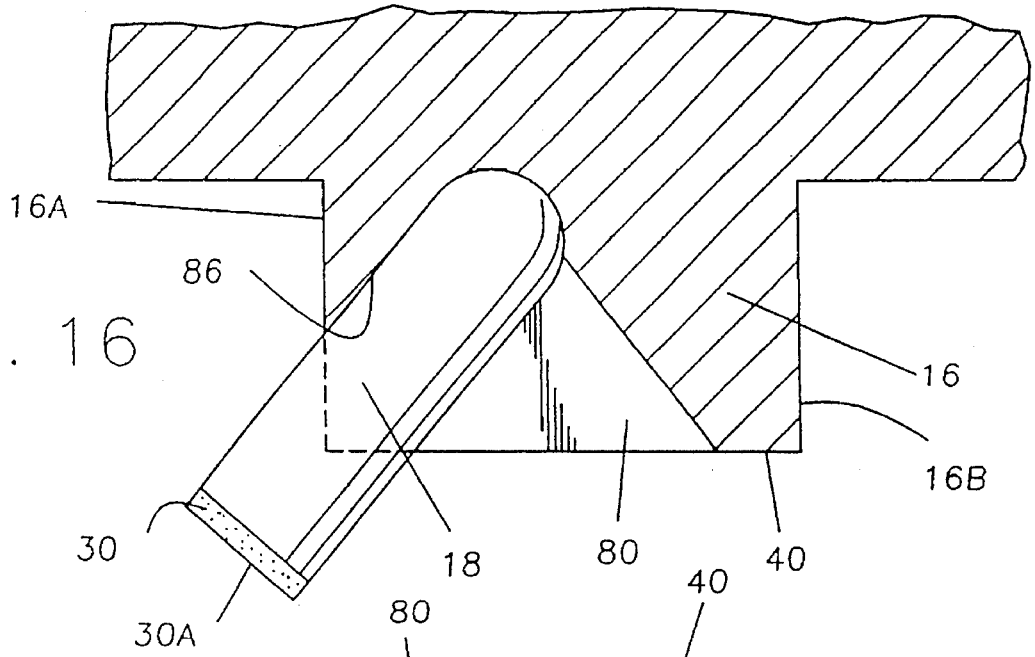
FIG. 16 is an alternative embodiment of a cutter brazed into place within a pocket in a fib of the drill bit illustrated in FIGS. 1 and 2 but having a steeper angle away from the top surface of the rib.
Figure 17:
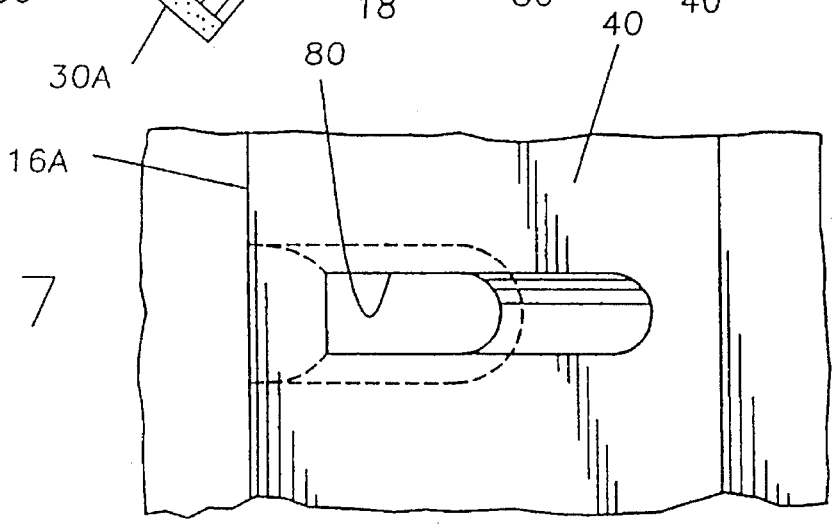
FIG. 17 is a top plan view of the slot milled into the top surface 40 of the embodiment of FIG. 16.

FIG. 16 illustrates a slightly different embodiment in which the slot 80 is milled at an increased angle over that illustrated in FIG. 14 and commences in the surface 40 removed from its intersection with surface 16A. FIG. 17 shows a top plan view of the surface 40 having the slot 80 milled therein. The reduced shank end mill illustrated in FIG. 12 is then used to mill out the pocket 86, into which the cutter 18 is brazed. The slot 80 is filled with braze material.

It should be appreciated that in both of the embodiments of FIGS. 14 and 15, the cutting face 30A extends below the surface 40.

Figure 18:
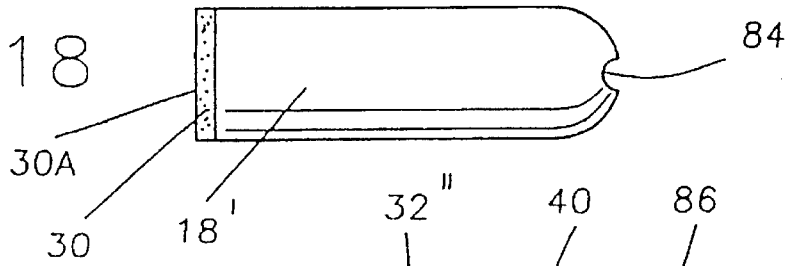
FIG. 18 is a pictorial representation of an alternative embodiment of the cutter assembly having a receptacle at its spherical shaped end to receive a pin illustrated in FIG. 20.
Figure 20:
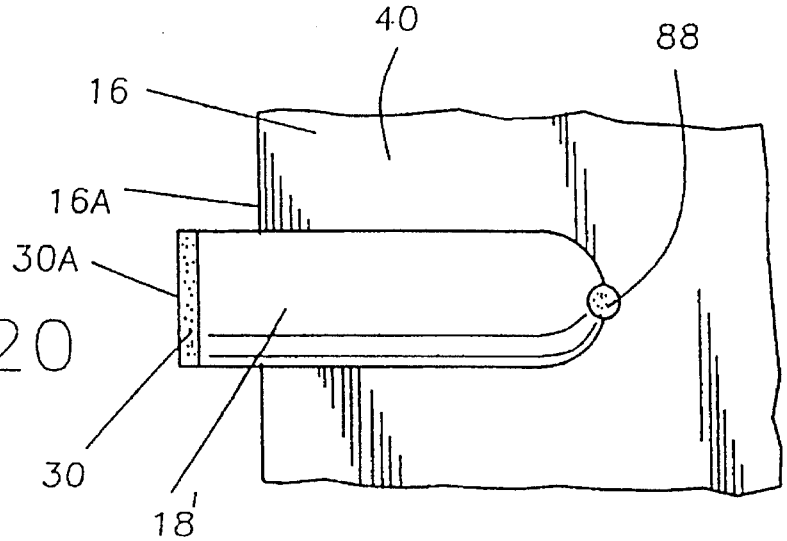
FIG. 20 is a top plan view of the cutter assembly illustrated in FIG. 18 brazed into place within the pocket illustrated in FIG. 19 and having a pin brazed therein to anchor the cutter assembly into the pocket.
Figure 21:
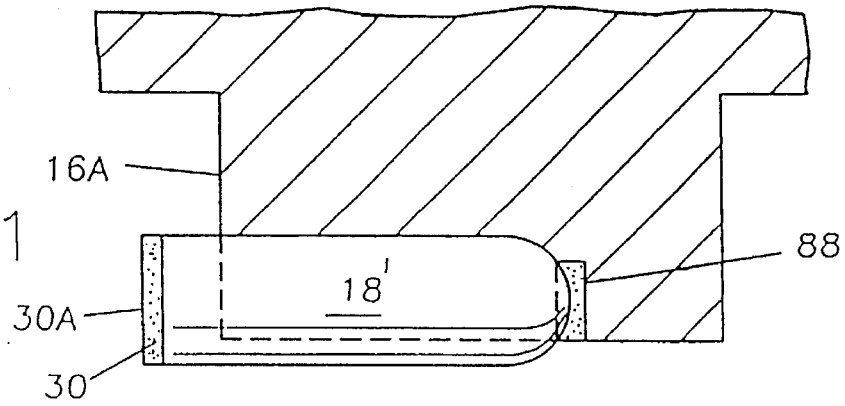
FIG. 21 is an elevated view of the cutter assembly of FIG. 18 brazed into place within the pocket illustrated in FIG. 19 and having the pin brazed therein to anchor the cutter assembly into the pocket.

With reference now to FIG. 18, a second embodiment of the bullet-shaped cutter 18' is illustrated as having a semicircular receptacle 84 that is configured to receive the pin 88 illustrated in FIG. 20.

Figure 19:
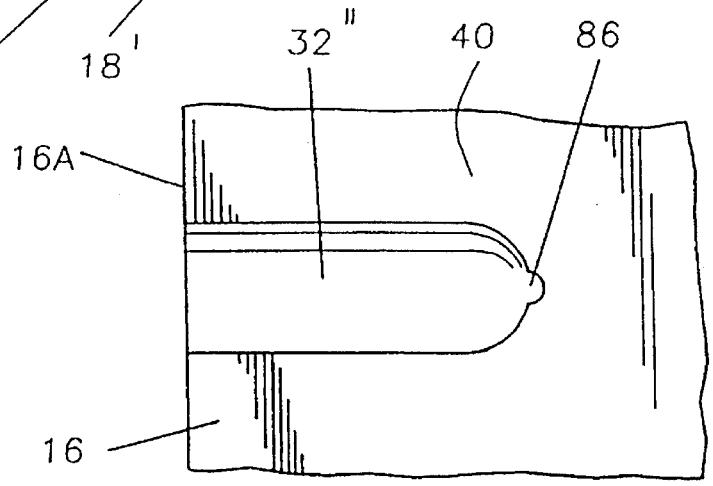
FIG. 19 is a pictorial representation of a pocket having a receptacle at its spherical shaped end to also receive the pin illustrated in FIG. 20.

FIG. 19 illustrates a different embodiment of the pocket 32" shown as having a semicircular receptacle 86 configured into the spherical end of the pocket 32".

FIG. 20 shows an elevated view of the cutter 18' brazed into place in the pocket 32" and also having the pin 88 brazed into place to anchor the cutter 18' within the pocket 32".

It should be appreciated that the cutter and pocket assembly illustrated in FIGS. 18–21 is intended to remedy a potential problem associated with the embodiment of FIG. 5. In viewing the embodiment of FIG. 5, it will be immediately recognized that as the cutter face 30A cuts into the earth's formations, there will be a tendency for the cutter 18 to be pushed out of the pocket 32' illustrated in FIG. 6. By brazing the pin 88 of FIG. 21 into the matching receptacles 84 and 86 during the assembly process, the cutter 18' will be anchored into the pocket 32" to prevent the cutter from being pushed up out of the pocket. The receptacles 84 and 86 and the pin 88 can also be used to provide orientation of the cutter 18' in the pocket 32" such as, for example, whenever the cutter 18' has one of its sides flattened, either intentionally or unintentionally, or in the case of the cutter face 30 having a specific orientation such as, for example, whenever CLAW cutters are used in bits manufactured by DB Stratabit, Inc., a sister company of Baroid Technology, Inc., the Assignee of the present application.

Figure 22:
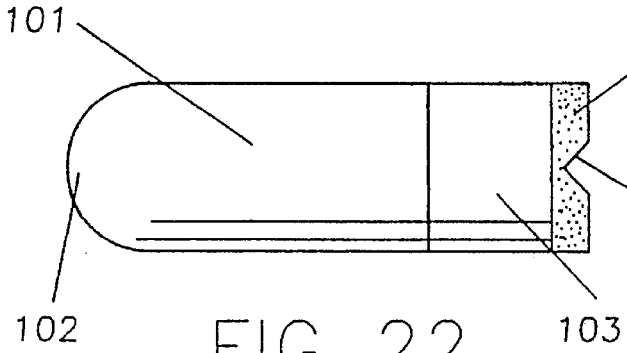
FIG. 22 is a pictorial view of a bullet-shaped cutter in accord with the present invention having an alternative embodiment of the invention, including a non-planar cutter face.
Figure 23:
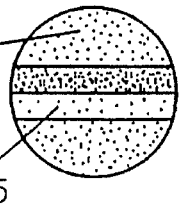
FIG. 23 is an end view of the cutter illustrated in FIG. 22.

With reference now to FIG. 22, there is illustrated a bullet-shaped cutter 101 having a spherical end 102 and a cutter assembly 103 and 104 that comprises a carrier body 103 of tungsten carbide and a PDC cutter face 104 that has a V-shaped groove 105 across its face. The groove may have its median length (the apex of the groove) on the diameter of the cutter face, or may be on another chord if desired.

Figure 24:
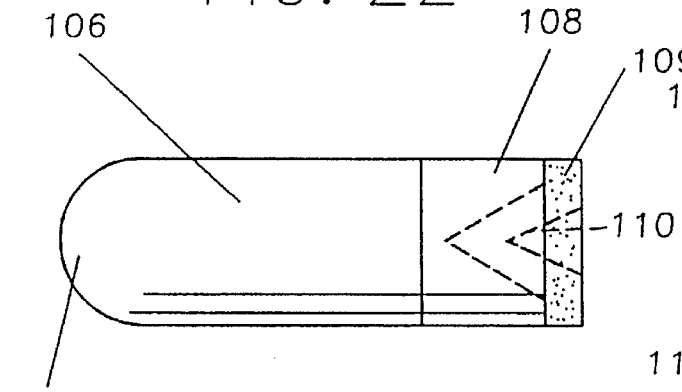
FIG. 24 is an alternative embodiment of the present invention having an alternative, non-planar cutter face.
Figure 25:
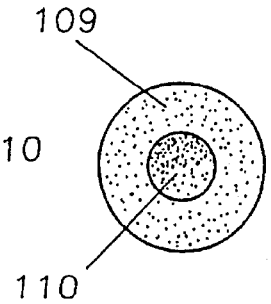
FIG. 25 is an end view of the cutter illustrated in FIG. 24.

FIG. 24 illustrates another bullet-shaped cutter assembly 106 having a spherical first end 107. Its other end has a tungsten carbide carrier 108 and a PDC cutter face 109 having therein a conically shaped orifice 110.

Figure 26:
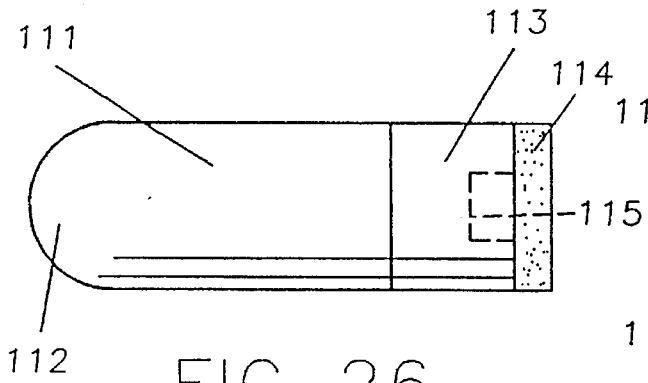
FIG. 26 is an alternative embodiment of the present invention showing an alternative, non-planar cutter face.
Figure 27:
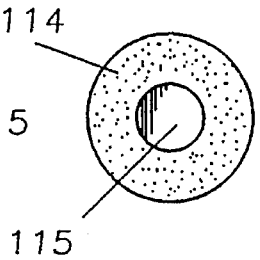
FIG. 27 is an end view of the cutter illustrated in FIG. 26.

FIG. 26 illustrates yet another bullet-shaped cutter assembly 111 having a spherical first end 112 and at its other end a tungsten carbide carrier 113 and a PDC cutter face 114. A center hole 115 extends through the cutter face 114 and also extends into the tungsten carbide carrier 113.

Figure 28:
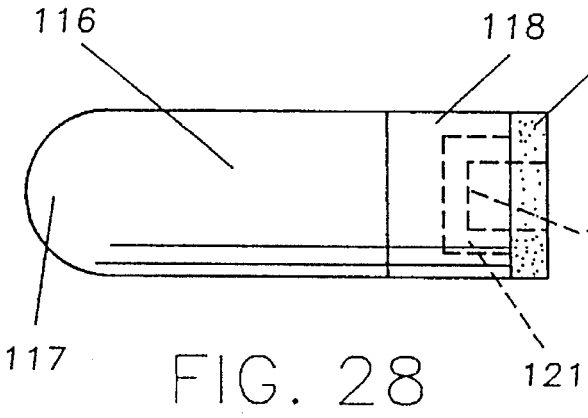
FIG. 28 is an alternative embodiment of the present invention showing an alternative, non-planar cutter face.
Figure 29:
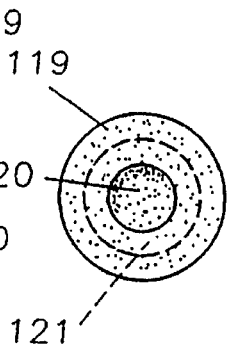
FIG. 29 is an end view of the cutter illustrated in FIG. 28.

FIG. 28 illustrates yet another bullet-shaped cutter assembly 116 having a spherical first end 117 and having at its second end a tungsten carbide carder 118 and a PDC cutter face 119. A center hole 120 extends completely through the PDC cutter face 119 and also extends into the tungsten carbide carrier 118. A layer of PDC material 121 surrounds the center hole 120.

Figure 30:
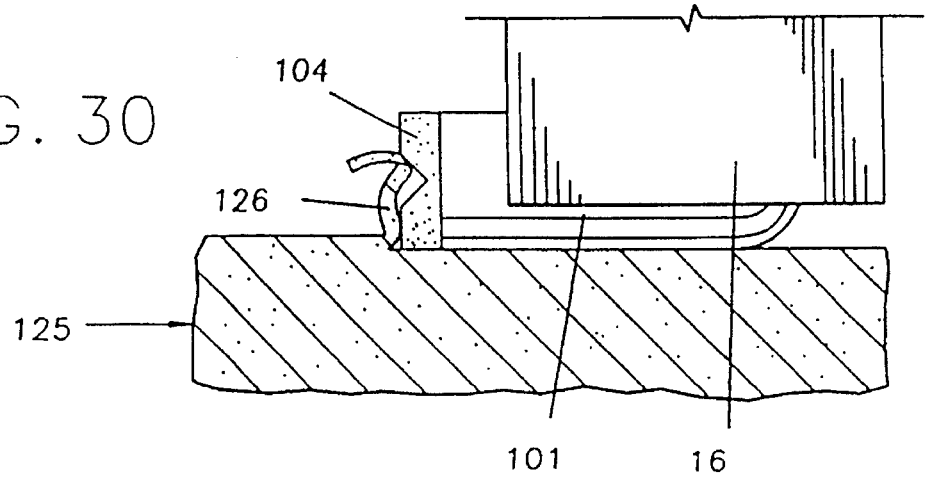
FIG. 30 is a pictorial, schematic view of the cutter assembly of FIG. 22 in the process of breaking a chip.

FIG. 30 illustrates the utility of the chip-breaker cutter assemblies illustrated in FIGS. 22–29. For example, the cutter assembly 101 illustrated in FIG. 22 is brazed into a pocket in a rib 16 in the same manner as was illustrated in FIG. 5. As the cutter assembly 101 cuts into the earth formation 125, it is common practice that small slivers or chips 126 are generated. Since it is desirable to break the chips off, the cutter face 104 having the V-shaped indentation 105 causes the chip 126 to break off. In a similar manner, the embodiments illustrated in FIGS. 22–29 will cause the chips from the formation to enter the orifices 110, 115 or 120 and thus be broken off.

Figure 31:
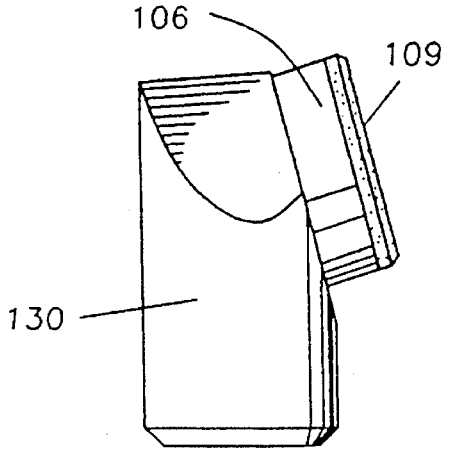
FIG. 31 is an elevated view of one of the cutter faces illustrated in FIGS. 24–29 mounted on a conventional stud body.

FIG. 31 illustrates a cutter assembly, for example, the cutter assembly 106 illustrated in FIG. 24, which demonstrates that the chip breaker cutter faces and their underlying tungsten carbide carriers can be mounted on a conventional stud assembly as an alternative to the embodiments illustrated hereinbefore in which they are mounted on the bullet-shaped cutter assemblies.

Figure 32:
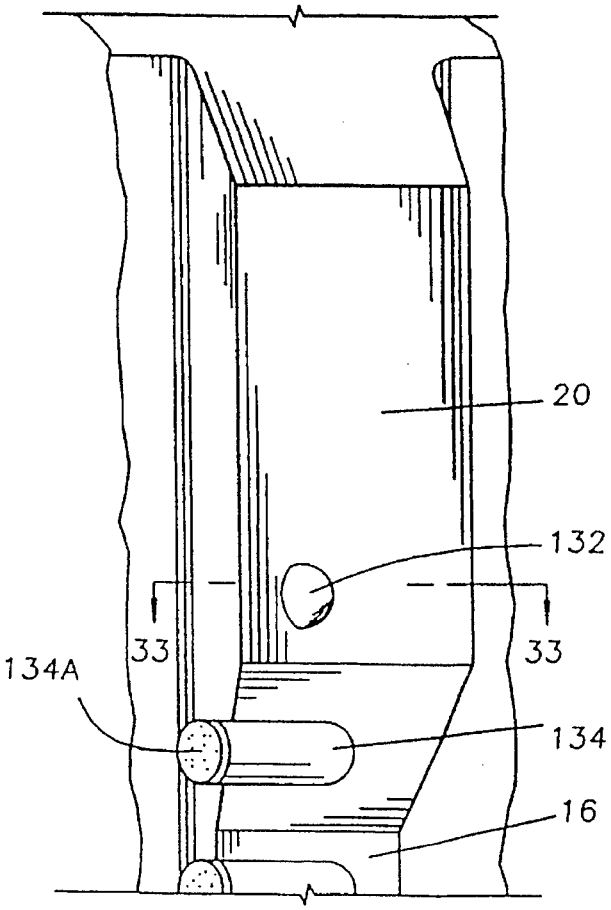
FIG. 32 is an alternative embodiment of the present invention illustrating the use of a tungsten carbide button or insert on the gauge diameter of the drill bit.
Figure 33:
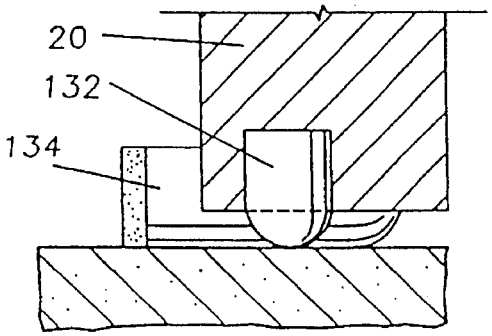
FIG. 33 is an end view of a tungsten carbide button illustrated in FIG. 32

FIG. 32 illustrates an alternative embodiment of the present invention in which each of the stabilizer ribs or kickers 20 of FIGS. 1 and 2 is modified to include a tungsten carbide button or insert 132 above the gauge cutter assembly 134. The tungsten carbide button is at the gauge diameter and is positioned to be at exactly the same diameter as the cutting face 134A. It should be appreciated that each of the stabilizers 20 has such a tungsten carbide button 132 placed thereon at the gauge diameter.

As a conventional PDC drill bit rotates, it tends to dig into the side of the borehole. This phenomenon reinforces itself on subsequent passes of the bit. Progressively, a non-uniformity is generated in the borehole wall, causing an impact on the gauge cutter in response to the wobble of the bit. Thus, because PDC bits tend to make the borehole slightly larger than the gauge diameter of the bit, often times causing the bit to wobble as it rotates, the stabilizer ribs 20 are otherwise exposed to high impact forces that can also damage the cutter assemblies such as the cutter assembly 134. To minimize this impact upon the cutter assemblies and the bit, the tungsten carbide button, being at the gauge diameter, protrudes laterally just ahead of the other cutting elements. The protrusion takes the impact instead of the cutter, and thus protects the cutter structure. The button 132 can be manufactured from tungsten carbide or any other hard metal material, or it can be steel coated with another hard material or the like. The present invention overcomes this problem by positioning the tungsten carbide insert on the stabilizer rib to take the impact that would have otherwise been inflicted on the cutter assembly.

Figure 34:
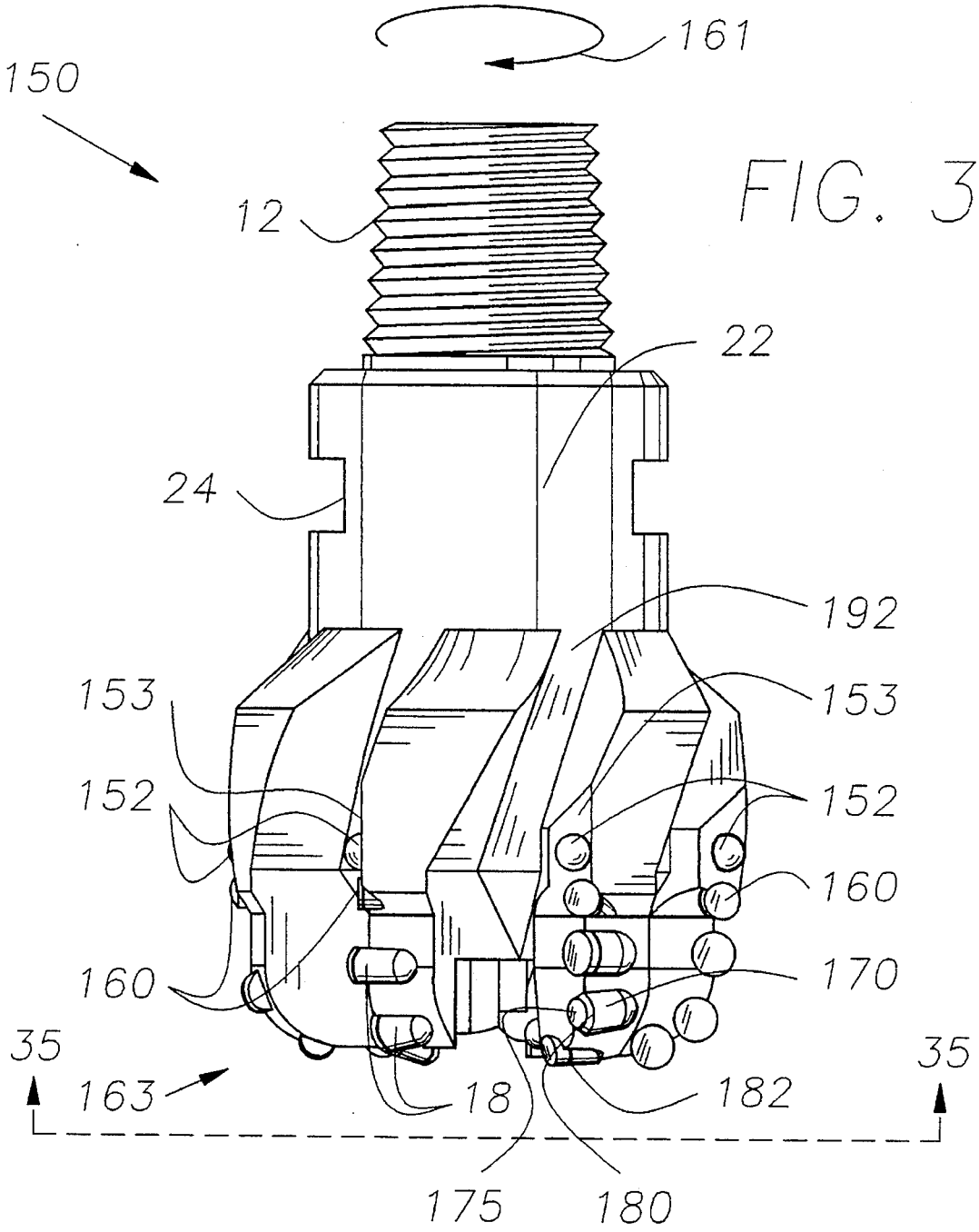
FIG. 34 is an elevational view of a drill bit having a hemispherical metallic insert and penetration limiter disposed thereon.
Figure 35:
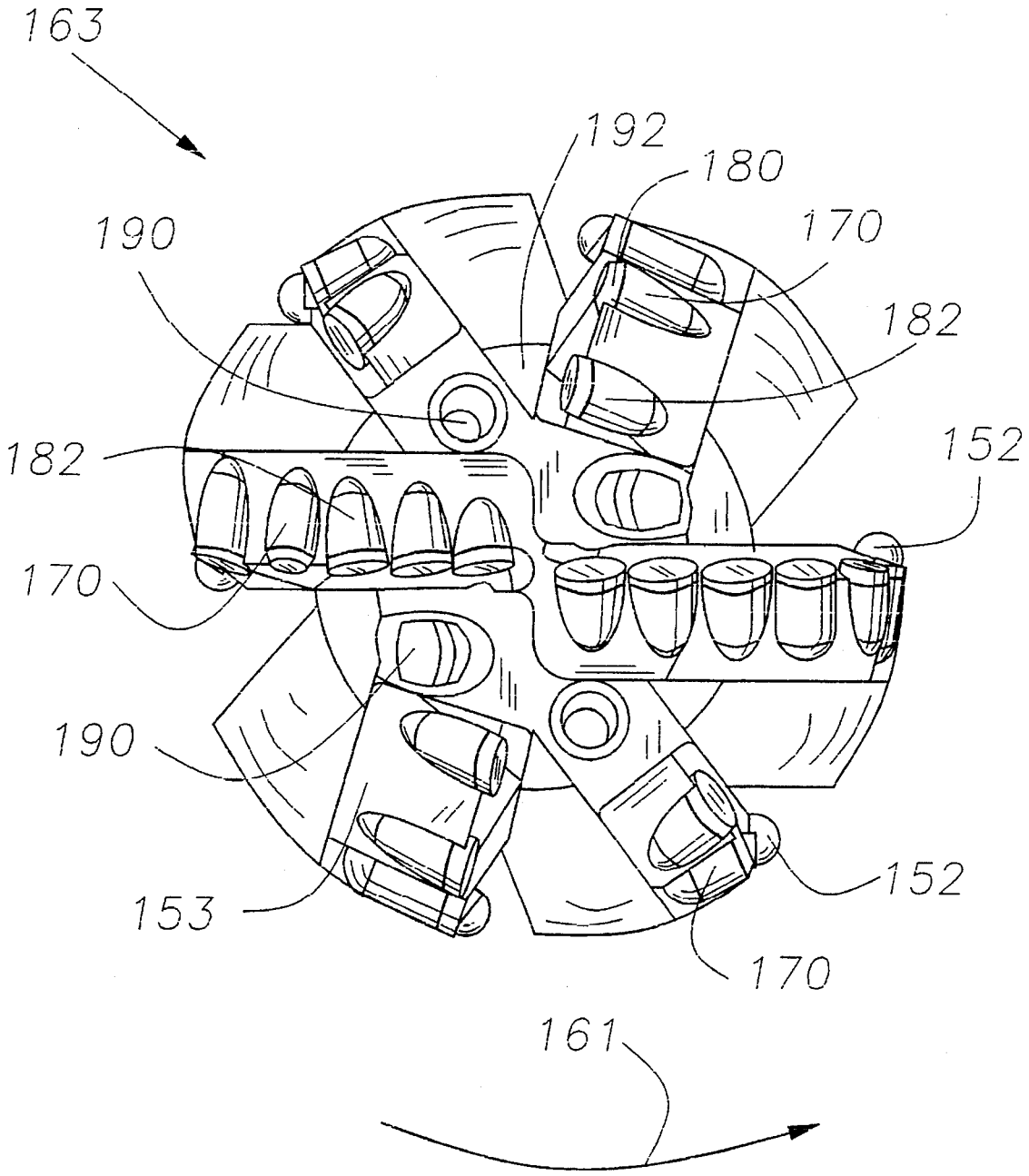
FIG. 35 is a bottom view of the drill bit of FIG. 34 along lines 35—35.
Figure 36:
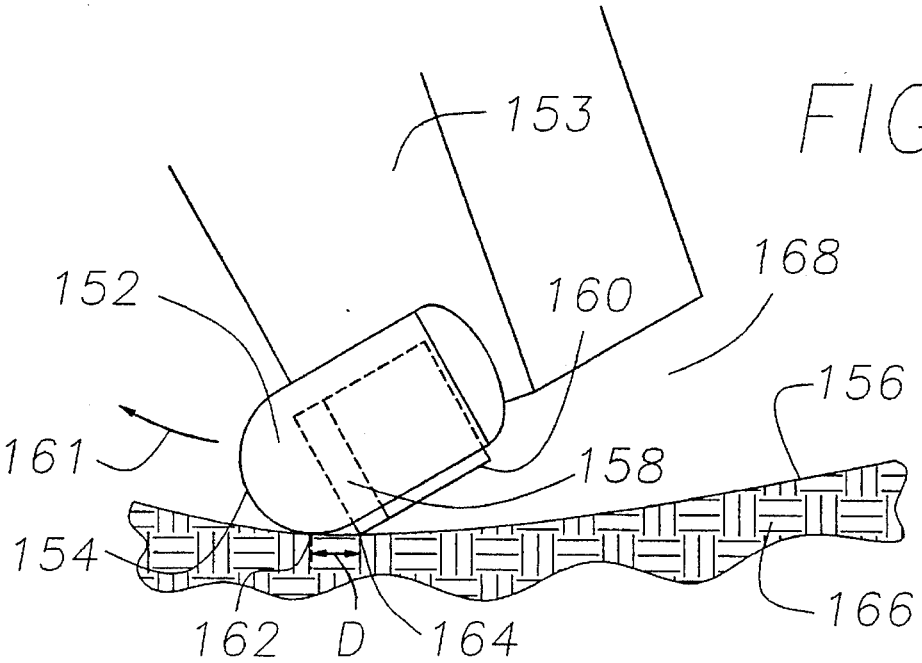
FIG. 36 is a schematical view of a hemispherically surfaced metallic insert engaging a borehole wall just prior to a PDC cutter element with respect to bit rotation direction.

FIGS. 34, 35, and 36 illustrate the above concept in more detail. Referring to FIG. 36, tungsten carbide button 152 has a spherical, bullet-shaped sliding surface 154 to substantially slidingly engage borehole wall 156 rather than cut into formation 166 as a PDC cutter does. Like button 134, button 152 protrudes from blade or upset 153 to the gauge diameter of the bit in a presently preferred embodiment of the present invention. The borehole will typically be described as having a borehole gauge diameter, the ideal size borehole produced by due to the specific size of the bit, although the actual size of the borehole will often vary from the borehole gauge diameter depending on the formation hardness, drilling fluid flow, and the like.

Thus, button 152 is preferably positioned to be at exactly the same diameter as the adjacent cutting face, in this case cutting face 158 of final PDC cutter assembly 160 (see FIG. 34). Final PDC cutter assembly 160 is one of the plurality of PDC cutting assemblies 18 and is the cutter assembly for its respective upset spaced furthest from the end of bit cutting face 163 in the axial direction toward the threads 12. Each upset would have a final PDC cutter assembly 160.

Button 152 extends by distance D just ahead of the adjacent cutting element in the direction of drilling bit rotation as indicated by rotation direction arrow 161 or, as stated hereinbefore, in the direction laterally just ahead of the other cutting elements such as PDC section 158 of PDC cutter assembly 160. Button 152 takes the impact, instead of PDC cutter assembly 160 thereby protecting PDC cutter assembly 160.

Distance D will vary depending on bit size but typically ranges from about one-eighth to about five-eighths of an inch with about three-eights to one-half of an inch being typical. In terms of degrees around the general circumference of drill bit 150, the contact point 162 of button 152 to contact point 164 of PDC element 158 may typically range from about one degree to about fifteen degrees with about five or six degrees being most typical on a new bit. The points of contact, 162 and 164, will widen as the bit wears.

The sliding surface 154 of button 152 is substantially hemispherical in the presently preferred embodiment. Therefore, sliding surface 154 slides not only laterally or rotationally in the direction of drilling bit rotation 161 but also slides axially with respect to the drill string. Sliding surface 154 could have other shapes, with the criteria being that surface 154 substantially slides, rather than cuts into formation 166, especially laterally or rotationally in the direction of drill bit rotation 161. Conveniently, the bullet-shaped design of a tungsten carbide cutter body is readily provided because the bullet shaped body member 18, as discussed hereinbefore, may simply be reversed to provide a readily available button member 152 having the presently desired sliding surface 154. Button 152 is shown in FIG. 34 and FIG. 35 on each upset 153 as discussed further hereinafter.

By maintaining substantially continuous sliding contact with borehole wall 156, button 152 not only protects the PDC cutting elements against impact with borehole irregularities but also performs the function of preventing or limiting bit whirl to thereby significantly stabilize drill bit 150 within borehole 168. Button 152 prevents final PDC cutter assembly 160 from cutting too deeply in a radially outwardly direction to thereby limit radial motion of bit 150 and thereby limiting whirling. Reduced or limited whirling results in less damage to the drill bit and also makes the bit much easier to directionally steer without "walking" in an undesired direction as may occur with other less stable drill bit designs.

Figure 37:
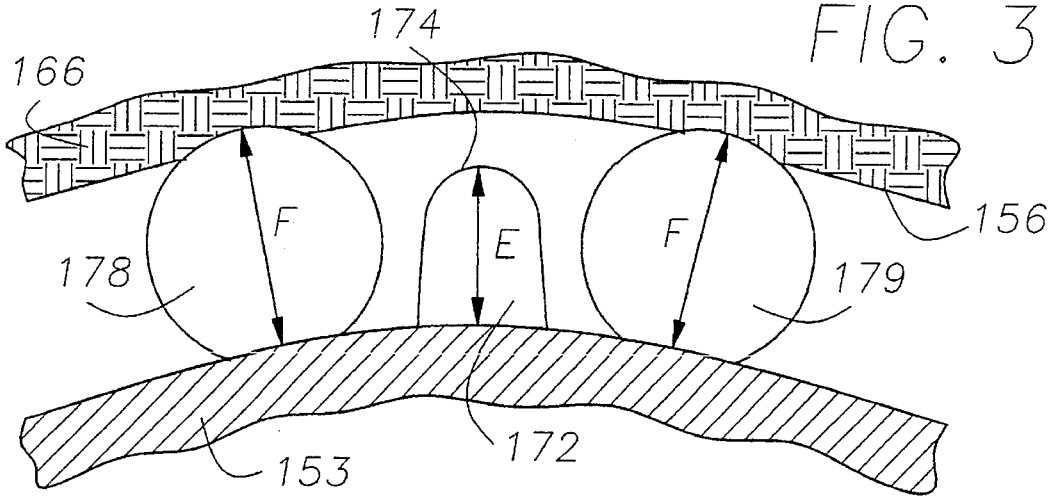
FIG. 37 is a schematical view showing a metallic insert between two PDC cutting assemblies.

Referring to FIG. 37, another embodiment of the present invention is shown. Button 172 is preferably a bullet shaped member, like button 152 discussed hereinbefore, that may also be used on cutting face 162 of the bit 150. In this embodiment, button 172 is used as a penetration limiter and is positioned between two neighboring cutters 178 and 179.

Button 172 is generally in-line with neighboring PDC cutting elements 178 and 179. Button 172 is preferably not placed in front of or behind the neighboring PDC cutting elements 178 and 179, with respect to the bit rotation direction, as in the prior art. Therefore, button 172 remains operational even if the bit becomes twisted or tilted in some manner that would lift such a prior art penetration limiter away from borehole wall 156 to become inoperative due to positioning in front of or behind neighboring PDC cutting elements 178 or 179.

When button 172 is used on drill bit 150 for this purpose, sliding surface 174 extends outwardly toward borehole wall 156 from upset or blade member 153 by an engagement distance E. Engagement distance F of neighboring PDC cutter assembly is the distance by which neighboring PDC cutter assemblies 178, 179 extend in the direction of the borehole wall 156 or formation 166. The engagement distance E of sliding surface 174 is preferably less than the engagement distance F of neighboring PDC cutter assembly 178. Button 172 therefore acts as a penetration limiter that does not engage formation 166 until neighboring PDC cutter assembly 178 cuts too deeply the formation. Surface 174 is shaped to substantially slide along rather than cut into formation 166 and therefore limits the formation penetration of neighboring PDC cutting elements 178 and 179. In this manner, surface 174 promotes bit stability by restricting bit tilting or bit whirling. Thus, surface 174, which is preferably bullet shaped or hemispherical surface to slide rather than cut, does not normally engage borehole wall 156 except when necessary to provide increased stability. It will be noted that distance F may not always be the equal for neighboring PDC cutting assemblies 178, 179, but will preferably always be greater than E.

Figure 37A:
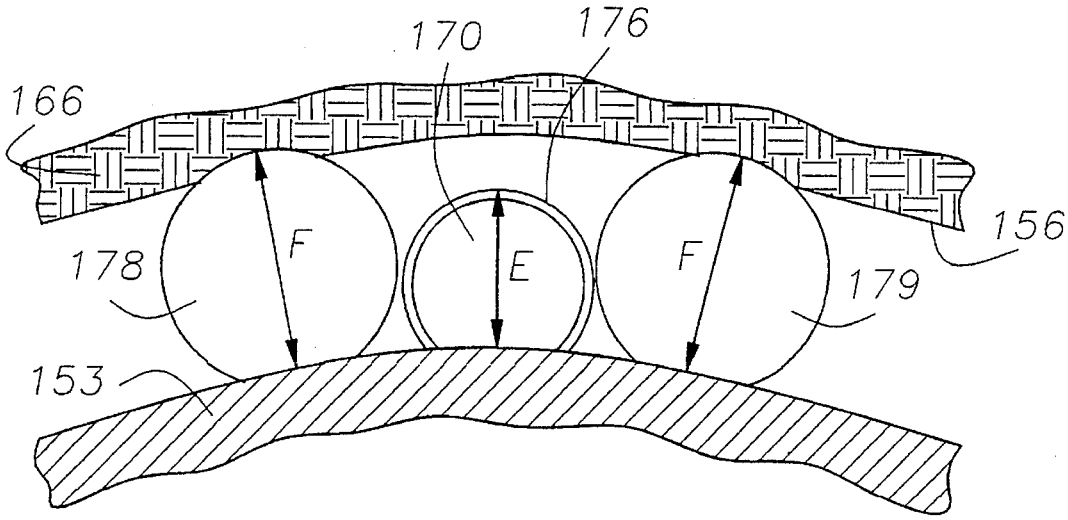
FIG. 37A is a schematical view showing a shaped cutter between two PDC cutting assemblies.

As shown in FIG. 37A, which is the presently preferred embodiment, shaped cutter 170 is used in place of button 172 as a penetration limiter. Shaped cutter 170 has significant advantages over button 172 for use as a penetration limiter, as discussed hereinafter. It will be understood by those skilled in the art that comments concerning uses of button 172 as a penetration limiter, as discussed hereinbefore, are generally applicable to use of shaped cutter 170 as a penetration limiter. Thus, distance E as applied to shaped cutter 170, is also the distance shaped cutter 170, or more specifically the body 176 of shaped cutter 170, extends toward borehole wall 156 or formation 166. Distance F will be greater than distance E, when the bit is new. Shaped cutter 170 will not normally contact the borehole wall or wellbore when the bit is new. Shaped cutter 170 will contact borehole wall 156 when neighboring PDC cutting assemblies, such as 178 or 179, dig too deeply into formation 166. Shaped cutter 170 is disposed between and in-line with neighboring cutter assemblies 178, 179.

While the distances E and F will change considerably with bit size and construction, they could typically range from about 0.1 to about 1.25 inches with typical values being from about 0.4 to about 0.7 inches.

Figure 38:
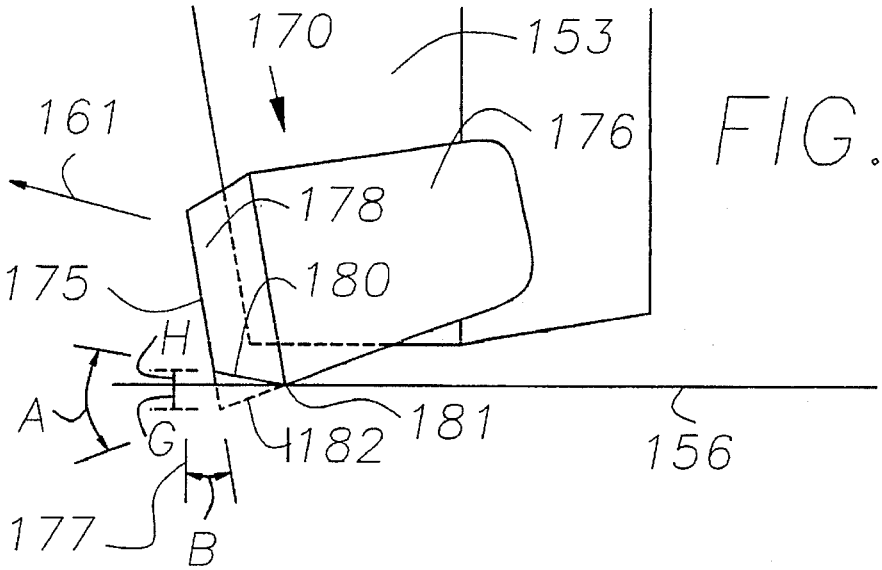
FIG. 38 is a schematical view showing engagement of shaped cutter to borehole where the bevel angle of the PDC element is greater than the backrake angle of cutter.

The basic features of shaped cutters 170 are perhaps best illustrated with reference to FIG. 38 wherein an enlarged shaped cutter 170 is schematically indicated. Shaped cutter 170 preferably includes a generally bullet shaped tungsten carbide body 176. A PDC cutting element 178 is secured thereto. Shaped cutter 170 is mounted to blade 153 at a backrake angle B, i.e., the angle of PDC face 175 with respect to the normal 177 to borehole wall 156 as shown in FIG. 38.

PDC portion 178 includes a frustoconical or beveled edge 180. For the presently preferred embodiment, angle A of the beveled edge is greater than backrake angle B. In this manner, it will be noted that body 176 rather than PDC portion 178 engages borehole wall 156, when engagement occurs as discussed above. For instance, PDC cutting portion 178 may be ground at a 30° angle while the backrake angle is 20°. Thus, there is a 10° angle between PDC portion 178 and borehole wall 156. In this manner, PDC portion 178 is substantially prevented, at least initially, from cutting into the formation like other PDC cutter assemblies such as neighboring PDC cutter element 182. Surface 181 extends radially outwardly toward the formation by a distance H which could typically range from about 0.02 to 0.40 inches with typical values of about 0.05 to 0.30 inches.

As stated hereinbefore, under normal drilling conditions, when bit 150 is new and relatively unworn, sliding surface 181 of shaped cutter does not normally engage borehole wall 156 at all. PDC cutter element 182 extends outwardly further than surface 181 by distance G for this purpose. Distance G could typically range from about 0.03 to about 0.40 inches depending on bit size. Typical values are about from 0.10 to 0.30 inches.

When drill bit 150 is new, sliding surface 181 engages borehole wall 156 only when adjacent PDC cutter assemblies, such as PDC cutter assembly 182 cuts too deeply into formation 166. However, if neighboring PDC cutter assembly 182 cuts too deeply into formation 162, then sliding surface 181 engages borehole wall 156 in a substantially slidingly rather than cuttingly manner to limit further penetration by PDC cutting assemblies such as PDC cutting assembly 182. In this way, penetration limiter shaped cutters 170 act to restrict tilting and whirling of bit 150. Shaped cutters 170 are disposed in-line with the other PDC cutter assemblies on bit as discussed previously so that they remain effective even if the bit twists or tilts as when, for instance, excessive loads are applied to the bit.

As bit 150 wears due to rotation, PDC cutter assembly 182 wears and surface 181 on shaped cutter 170 also wears, Wear on both items continues to the point where PDC portion 178 of shaped cutter 170 begins to engage borehole wall 156 substantially continuously. At this time, shaped cutter 170 essentially becomes just like the other PDC cutters. Thus, shaped cutter 170 acts as an ideal penetration limiter that "disappears" after the bit is worn.

As discussed hereinbefore, after the bit is worn, bit stabilization using penetration limiters is generally unnecessary because the worn surfaces themselves act to stabilize the bit. Additional surfaces, such as those of a prior art penetration limiter, increase the torque necessary to rotate the bit without providing any substantial additional bit stabilization. As well, on a worn bit, such prior art penetration limiters are inefficient because the contact of the penetration limiters is substantially continuous rather than limited to prevent excessive cutter penetration.

Although various shapes for shaped cutter 170 may potentially are possible, it is desired that (1) shaped cutter is profiled such that a substantially sliding surface engages the formation, i.e., the surface substantially slides rather than cuts (2) the sliding surface does not normally engage the formation except when the bit forces are imbalanced, and (3) as the preferably carbide sliding surface wears away, along with the other PDC cutting assemblies, the PDC portion of the shaped cutter is eventually exposed to engage the formation substantially continuously as do the other PDC cutting assemblies, i.e., the penetration limiter "disappears" and a cutter takes its place.

Furthermore, the shaped cutters are placed in line with the standard cutters instead of behind the cutters as are prior art penetration limiters. Thus, regardless of which way the bit rocks or moves, the shaped cutter is still in place to limit excessive cutter penetration with a relatively new bit.

Referring to FIGS. 34 and 35, a presently preferred embodiment of the present invention is disclosed with the hereinbefore discussed tungsten carbide buttons 152 that extend to borehole gauge. Buttons 152 are used on each respective blade or upset 153. In this embodiment, buttons 152 are used on all blades 153. This arrangement, although presently preferred for many applications, is not absolutely necessary and may be varied based on hole conditions, cost limitations, or customer specifications. Generally it is desired that more than one carbide button 152 be used to stabilize the bit within the borehole.

In the embodiment of bit 150, three shaped cutters 170 are used on alternating blades although other configurations are possible. Shaped cutters 170, or penetration limiters in general, may be used independently of carbide buttons 152 as desired. Shaped cutters 170 are preferably mounted on a radially outwardly portion of face 163. At this position, there is more overlap among the cutters so as to better allow for in-line placement of a penetration limiter without substantially any reduction in cutting efficiency. As discussed hereinbefore, carbide buttons may also be used as penetration limiters in place of shaped cutters 170.

In operation of bit 150, ports 190 allow for drilling fluid circulation through recesses 192 between blades 153. Bit 150 is rotated in bit rotation direction 161. PDC cutting elements 18 and other elements as discussed above cut into the formation. Bit whirl is significantly reduced due to both the action of buttons 152 and shaped cutters 170. Buttons 152 tend to have little effect on bit tilting instability problems caused, for instance, by too much weight on the bit. However, shaped cutters 170 act to prevent instabilities from bit tilting as well as bit whirling.

Thus, the bit of the present invention is ideal for directional drilling purposes. The bit of the present invention also tends to wear significantly longer than a standard bit. As well, due to the higher level of bit stability, other related drilling components tend to last longer thus providing overall cost savings by use of the present stabilized bit.

The foregoing disclosure and description of the invention is illustrative and explanatory thereof, and it will appreciated by those skilled in the art, that various changes in the size, shape and materials as well as in the details of the illustrated construction or combinations of features of the various bit or coring elements may be made without departing from the spirit of the invention.

What is claimed is:

1. A method for enhancing drill bit stability while drilling a borehole through a formation, said drill bit having a drilling rotation direction, said borehole having a borehole gauge diameter and a borehole wall, said method comprising the steps of:

providing a plurality of PDC cutter assemblies each having a PDC portion and a body portion;

mounting said plurality of PDC cutter assemblies on a drilling bit, each of said plurality of PDC cutter assemblies being mounted so as to extend from said bit by a respective engagement distance so that said PDC portion of each of said plurality of PDC assemblies is engageable with said formation;

providing a penetration limiter metallic body member, said penetration limiter metallic body member being shaped to have a tendency to slide along said formation rather than cut into said formation;

bonding a penetration limiter PDC member to said penetration limiter metallic body member;

providing a beveled region on said penetration limiter PDC member, said beveled region having a bevel angle;

mounting said penetration limiter PDC member at a cutter backrake angle such that said bevel angle is greater than said backrake angle; and mounting said penetration limiter metallic body member between and in line with two of said plurality of PDC cutter assemblies, said penetration limiter metallic body being mounted to extend from said bit by an amount less than said respective engagement distance of said two of said plurality of PDC cutter assemblies such that said penetration limiter metallic body member engages said formation when at least one of said two of said plurality of PDC cutter assemblies cuts too deeply into said formation.

2. The method of claim 1, further comprising:

rotating said drill bit to thereby wear said plurality of PDC cutter assemblies and to wear said penetration limiter metallic body member, and mounting said penetration limiter PDC member to substantially continuously cut said formation after wearing said penetration metallic body member by a predetermined amount.

3. The method of claim 1, further comprising:

mounting said penetration limiter metallic body member on a laterally outwardly portion of said drill bit.

4. The method of claim 1, further comprising:

providing a hemispherically-shaped metal insert adjacent a final PDC cutter assembly axially spaced from said a cutting face of said drill bit.

5. The method of claim 1, further comprising:

providing a metal insert having a surface for slidingly engaging said borehole wall adjacent a final PDC cutter assembly axially spaced from said cutting face, and mounting said metal insert to engage said borehole wall just forward of said final PDC cutter assembly, with respect to said drilling rotation direction.

6. A drill bit for drilling a borehole through a formation, said borehole having a borehole gauge diameter and a borehole wall, said drill bit having a drilling rotation direction, said drill bit comprising:

a hard metal body having an end face;

a plurality of PDC cutter assemblies disposed on said end face for engaging said formation, said plurality of PDC cutter assemblies including at least one final PDC cutter assembly axially and radially spaced from a central region point of said end face;

a first metal body disposed adjacent said at least one final PDC cutter and having a first substantially smooth surface profiled to extend outwardly for substantially continuous sliding contact said borehole wall;

a second metal body disposed laterally outwardly with respect to said center point of said end face, said second metal body having a second substantially smooth surface profiled to extend outwardly a distance less than a neighboring PDC cutter and being operable to engage said formation when said neighboring PDC cutter cuts too deeply into said formation; and a PDC member secured to said second metal body, said PDC member having a cutting edge and a frustoconical surface on said PDC member, said frustoconical surface having an angle greater than a rake angle of said second metal body.

7. The drill bit of claim 6, wherein:

said first substantially smooth surface is profiled to contact said borehole wall at said borehole gauge diameter just forward of said at least one final PDC cutter, with respect to said drilling rotation direction.

8. A drill bit for drilling a borehole through a formation, said borehole having a borehole gauge diameter and a borehole wall, said drill bit having a drilling rotation direction, said drill bit comprising:

a hard metal body having an end face;

a plurality of PDC cutter assemblies disposed on said end face to form a line of PDC cutter assemblies, said plurality of PDC cutter assemblies including a final PDC cutter assembly disposed furthest from a center point of said end face; and a penetration limiter metal body disposed on said end face between two of said plurality of PDC cutter assemblies and being positioned along said line of PDC cutter assemblies, said penetration limiter metal body having an outer surface extending outwardly from said end face to a distance less than a distance said two of said plurality of PDC cutter assemblies extend outwardly from said end face, said outer surface of said penetration limiter metal body being operable to engage said formation when said neighboring PDC cutter cuts too deeply into said formation; and a PDC member secured to said penetration limiter metallic body, said penetration limiter metallic body extending outwardly from said end face further than said PDC member.

* * * * *